US008118204B2

(12) United States Patent
Ishida et al.

(10) Patent No.: US 8,118,204 B2
(45) Date of Patent: Feb. 21, 2012

(54) PORTABLE FASTENING TOOL

(75) Inventors: Hideki Ishida, Ibaraki (JP); Hitoshi Tsuzuki, Ibaraki (JP); Takeshi Matsuoka, Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 171 days.

(21) Appl. No.: 12/088,524

(22) PCT Filed: Sep. 1, 2006

(86) PCT No.: PCT/JP2006/317803

§ 371 (c)(1),
(2), (4) Date: Mar. 28, 2008

(87) PCT Pub. No.: WO2007/043260

PCT Pub. Date: Apr. 19, 2007

(65) Prior Publication Data

US 2009/0266863 A1 Oct. 29, 2009

(30) Foreign Application Priority Data

Sep. 30, 2005 (JP) ..... P2005-285902

(51) Int. Cl.
*B25C 1/04* (2006.01)

(52) U.S. Cl. ..... 227/130; 227/156; D8/68

(58) Field of Classification Search ..... 227/129–134, 227/156; D8/68
See application file for complete search history.

(56) References Cited

U.S. PATENT DOCUMENTS 1,845,617 A * 2/1932 Metcalf ..... 227/96
3,708,095 A * 1/1973 Briggs, Jr. ..... 227/126
3,771,709 A 11/1973 Breschinsky
(Continued)

FOREIGN PATENT DOCUMENTS

EP 0 663 269 7/1995
(Continued)

OTHER PUBLICATIONS

Taiwanese Office Action issued in Taiwanese Patent Application No. TW 095136170 dated Oct. 4, 2010.

*Primary Examiner* — Paul Durand
(74) *Attorney, Agent, or Firm* — McDermott Will & Emery LLP

(57) ABSTRACT

To provide a compact portable fastening tool which can be easily pushed at its handle portion onto a punched side, even in case a magazine is attached at an inclination with respect to the horizon, so that it can be easily used even in a narrow place. An electric fastening tool 1 comprises: a housing 2 having a handle portion 2B formed to extend from a trunk portion 2A; an ejection unit attached to the lower portion of the housing 2; a magazine 5 attached to the ejection unit; a motor housed in the housing 2; a battery pack 3 for driving the motor; a flywheel rotationally driven by the motor; a follower shaft selectively rotated by the kinetic energy of the flywheel; and a plunger adapted to be linearly moved in the housing 2 by the rotation of the follower shaft thereby to drive the nail fed into the ejection unit. The magazine 5 is so attached that it is inclined in a side view with respect to the trunk portion 2A of the housing 2 and that it is inclined in a bottom view with respect to the handle portion 2B of the housing 2.

15 Claims, 3 Drawing Sheets

U.S. PATENT DOCUMENTS

| | | | | |
|---|---|---|---|---|
| 3,820,705 | A | 6/1974 | Beals | |
| 3,893,610 | A | 7/1975 | Smith | |
| 4,121,745 | A * | 10/1978 | Smith et al. | 227/8 |
| 4,161,272 | A * | 7/1979 | Brockl | 227/131 |
| 4,298,072 | A * | 11/1981 | Baker et al. | 173/13 |
| 4,640,452 | A * | 2/1987 | Matt et al. | 227/131 |
| 4,811,885 | A * | 3/1989 | Lai | 227/131 |
| 5,320,270 | A * | 6/1994 | Crutcher | 227/131 |
| 5,511,715 | A * | 4/1996 | Crutcher et al. | 227/131 |
| 6,431,430 | B1 * | 8/2002 | Jalbert et al. | 227/131 |
| 6,607,111 | B2 * | 8/2003 | Garvis et al. | 227/131 |
| 6,669,072 | B2 * | 12/2003 | Burke et al. | 227/131 |
| 6,755,336 | B2 * | 6/2004 | Harper et al. | 227/129 |
| 6,779,697 | B2 * | 8/2004 | Lin | 227/120 |
| 6,796,475 | B2 * | 9/2004 | Adams | 227/2 |
| 6,886,730 | B2 * | 5/2005 | Fujisawa et al. | 227/8 |
| 6,971,567 | B1 * | 12/2005 | Cannaliato et al. | 227/2 |
| 6,974,061 | B2 * | 12/2005 | Adams et al. | 227/2 |
| 7,469,811 | B2 * | 12/2008 | Shima et al. | 227/131 |
| 7,494,036 | B2 * | 2/2009 | Shima et al. | 227/131 |
| 2002/0104869 | A1 | 8/2002 | Garvis | |
| 2004/0084501 | A1 | 5/2004 | Lin | |

FOREIGN PATENT DOCUMENTS

| | | |
|---|---|---|
| EP | 0 927 605 A2 | 7/1999 |
| JP | 6-278051 | 10/1994 |
| JP | 2002-127039 | 5/2002 |

* cited by examiner

PORTABLE FASTENING TOOL

RELATED APPLICATIONS

This application is the U.S. National Phase under 35 U.S.C. §371 of International Application No. PCT/JP2006/317803, filed Sep. 1, 2006, which claims priority of Japanese Patent application No. JP2005-285902, filed on Sep. 30, 2005, the contents of which are herewith incorporated by reference.

TECHNICAL FIELD

The present invention relates to a portable fastening tool for punching nails with a driving force established by a battery.

DESCRIPTION OF RELATED ART

A portable fastening tool of this kind is constituted by: a housing having a handle portion extending generally in a side elevation of T-shape from a generally cylindrical trunk portion; an ejection unit attached to the lower portion of the housing; a magazine attached to the ejection unit; a motor housed in the housing; a battery for driving the motor; a flywheel rotatably supported by the housing and rotationally driven by the motor; a follower shaft rotatably supported by the housing and selectively rotated by the kinetic energy of the flywheel; and a plunger linearly moved in the housing by the rotation of the follower shaft thereby to drive the nails fed into the ejection unit.

Of these portable fastening tools, there is a type, in which the nails connected in a step shape are housed in the magazine. In the portable fastening tool of this type, the magazine is so attached to the housing that it is inclined in a side view at the same angle as the connection angle of nails (as referred to JP-A-6-278051 and JP-A-2002-127039, for example).

In the portable fastening tool of the related art, on the other hand, the handle portion is formed at such an angle as close to the horizontal direction, so that the trunk portion of the housing may be easily pushed onto the punching side. Moreover, easy use of the portable fastening tool in a narrow place is also considered by keeping the trailing end portion of the handle portion of the housing (or the free end portion on the opposite side of the trunk portion) lower than the trunk portion.

SUMMARY OF INVENTION

In the related-art portable fastening tool, the magazine for housing a number of nails connected in the step shape is attached obliquely in a side view to the housing. In order to avoid the interference with the magazine, the handle portion has to be likewise inclined. If the handle portion is excessively inclined, however, there arise a problem to make it hard to push the trunk portion onto the punching side. If the trailing end portion of the handle portion of the housing is higher than the end portion on the trunk side, the portable fastening tool becomes tall as a whole thereby to deteriorate the operability and workability of the machine in a narrow place.

The invention has been conceived in view of the problems thus far described, and has an object to provide a compact portable fastening tool which can be easily pushed at its handle portion onto a punched side, even in case a magazine is attached at an inclination with respect to the horizon, so that it can be easily used even in a narrow place.

In order to achieve the above-specified object, according to an aspect of the invention, there is provided a portable fastening tool comprising: a housing having a handle portion formed generally in a T-shape in side elevation to extend from a generally cylindrical trunk portion; an ejection unit attached to the lower portion of the housing; a magazine attached to the ejection unit; a motor housed in the housing; a battery for driving the motor; a flywheel rotatably supported in the housing and rotationally driven by the motor; a follower shaft rotatably supported in the housing and selectively rotated by the kinetic energy of the flywheel; and a plunger adapted to be linearly moved in the housing by the rotation of the follower shaft thereby to drive the nail fed into the ejection unit. The portable fastening tool is characterized: in that the magazine is so attached that it is inclined in a side view with respect to the trunk portion of the housing and that it is inclined in a bottom view with respect to the handle portion of the housing.

According to another aspect of the invention, the magazine is attached at its one end to the ejection unit and at its other end to the trailing end portion of the handle portion of the housing such that the magazine is deflected to the right or left on its one end and is inclined in its bottom view by a predetermined angle with respect to the handle portion of the housing.

According to another aspect of the invention, the magazine is so arranged as to overlap a portion of at least the handle portion of the housing or the battery in a side view.

According to another aspect of the invention, there is provided a portable fastening tool comprising: a housing including a trunk portion and a handle portion; a battery disposed at the end portion of the housing; an ejection unit disposed at the lower end of the housing; a drive source caused by the battery to generate a driving force; a punching portion driven by the drive source; an ejection port for punching the nails fed to the ejection unit by the punching portion; and a magazine for holding the nails fed to the ejection unit. The portable fastening tool is characterized: in that the magazine is attached so obliquely from the side of the ejection port to the handle portion as to avoid interference with the battery.

According to another aspect of the invention, even in case the magazine is attached at an inclination with respect to the horizon, the position of the handle portion of the housing can be held nearly horizontal while avoiding the magazine, and the portable fastening tool can be easily pushed to the punching side while gripping the handle portion, so that the nailing operations can be stabilized.

According to another aspect of the invention, the magazine is so arranged that its portion overlaps either the portion of the handle portion of the housing or the battery in the side view. As a result, the height of the trailing end portion (or the end portion on the opposite side of the trunk portion) of the handle portion (i.e., the height from the leading end punching portion of the trunk portion) can be held small to make the electric fastening tool 1 so compact that it can be conveniently used in the narrow place, so that it can nail even a narrow place highly efficiently.

According to another aspect of the invention, the magazine is mounted obliquely, as viewed from the ejection port, with respect to the handle portion so as to avoid the interference with the battery. Even if the magazine is attached obliquely in the top plan view to the handle portion of the housing, the battery or a heavy component can be arranged at the low position so that the portable fastening tool can be well balanced in its weight and less damaged in its operation.

DESCRIPTION OF THE EMBODIMENTS

An embodiment of the invention is described in connection with an electric fastening tool as one mode of embodiment of a portable fastening tool with reference to the accompanying drawings.

Figure 1:
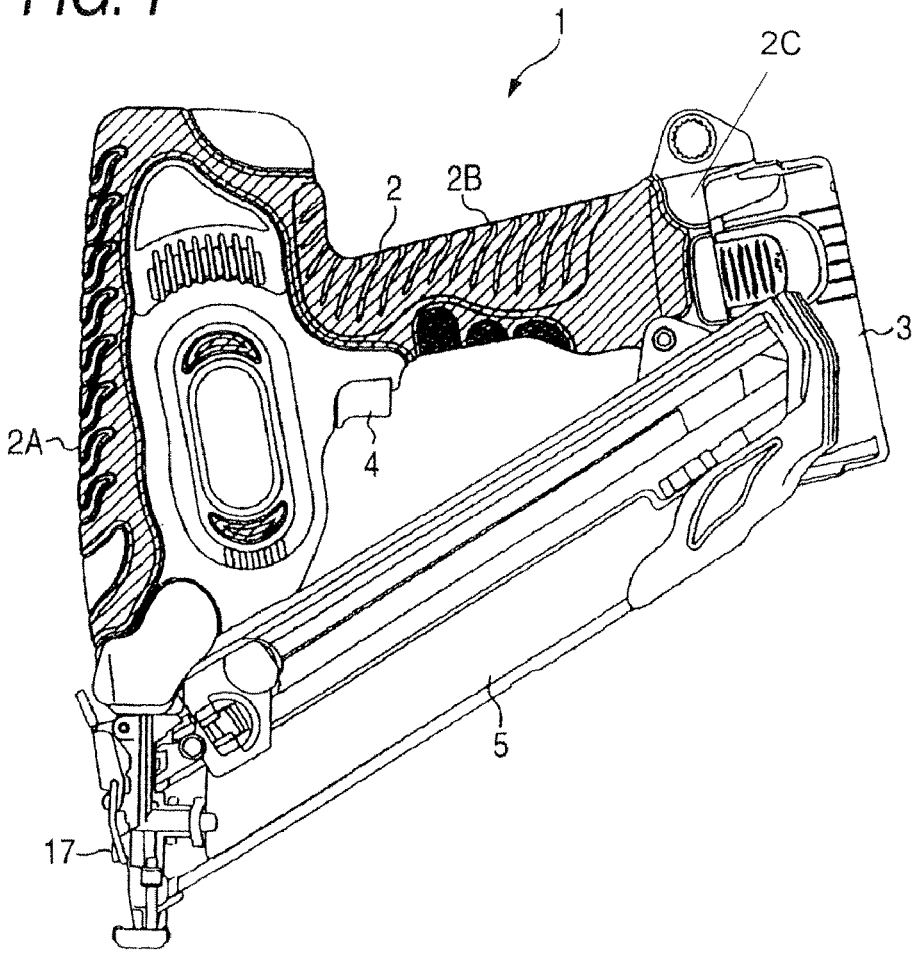
FIG. 1 is a lefthand side elevation of an electric fastening tool according to an embodiment.
Figure 2:
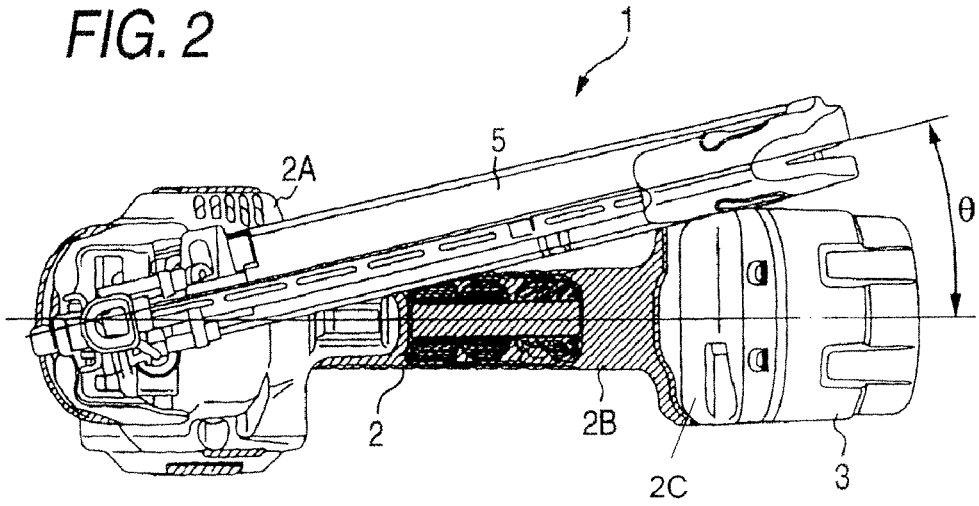
FIG. 2 is a bottom view of the electric fastening tool according to the embodiment.
Figure 3:
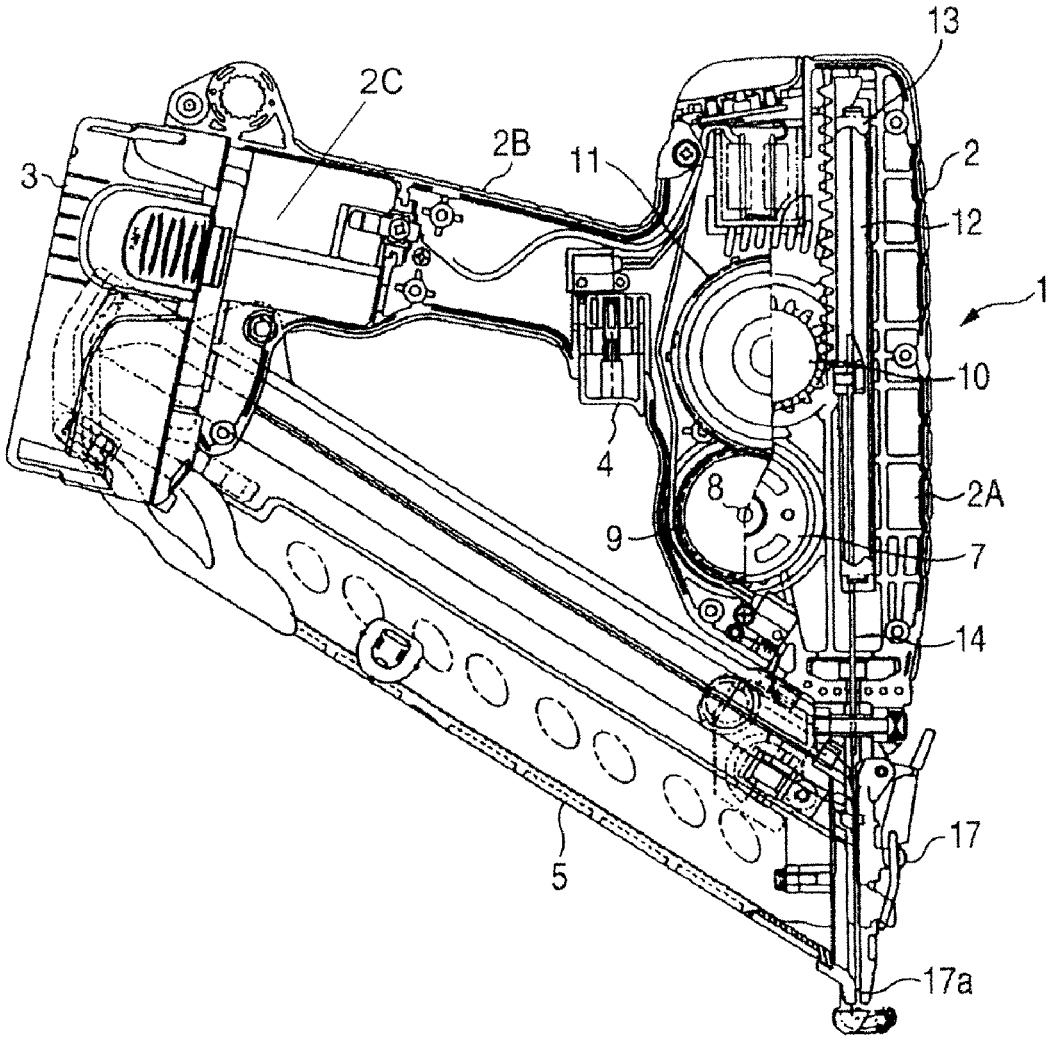
FIG. 3 is a broken righthand side elevation showing the internal configuration of the electric fastening tool according to the embodiment.
Figure 4:
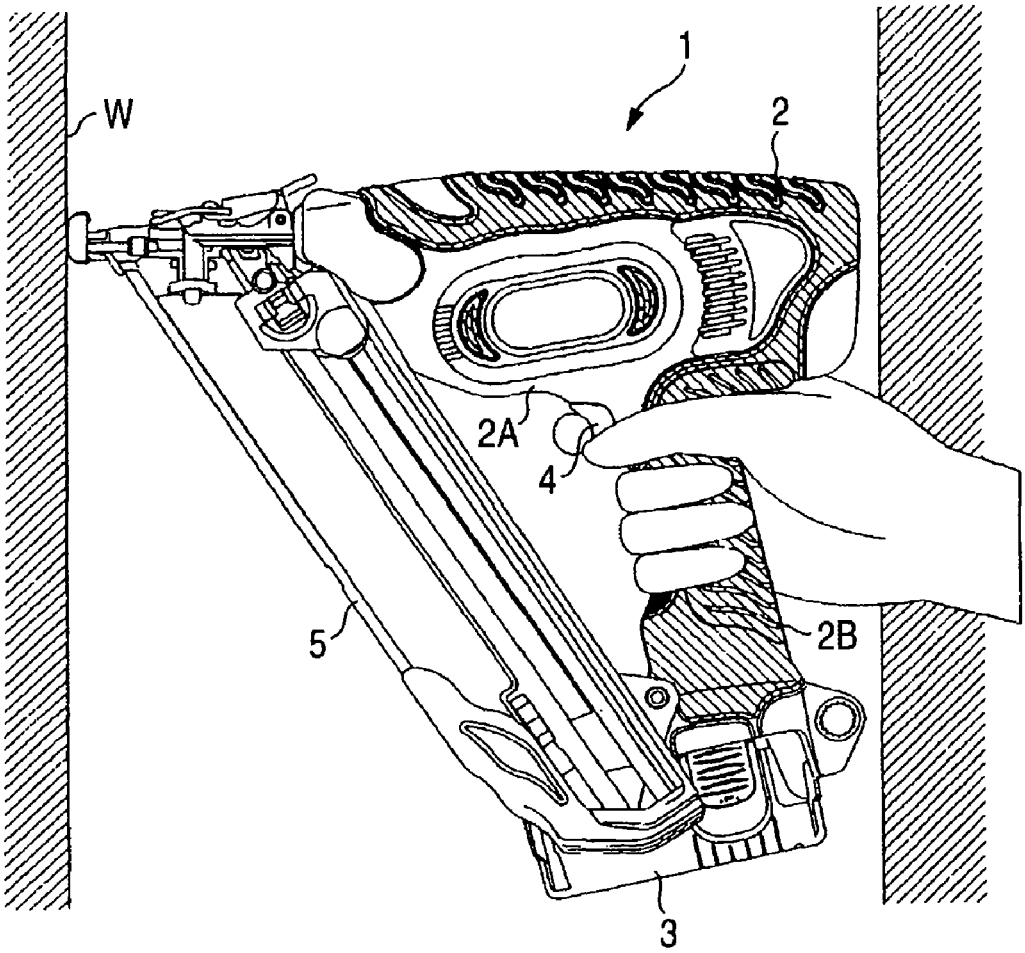
FIG. 4 is a side elevation showing the nailing operation using the electric fastening tool according to the embodiment.
Figure 5:
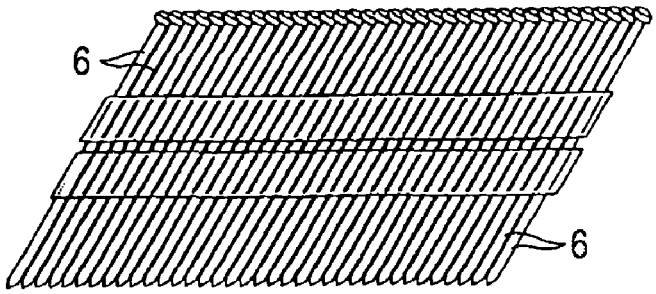
FIG. 5 is a side elevation of nails connected in a step shape.

FIG. 1 is a lefthand side elevation of an electric fastening tool (or a portable fastening tool) according to the invention; FIG. 2 is a bottom view of the same electric fastening tool; FIG. 3 is a broken righthand side elevation showing the internal constitution of the same electric fastening tool; FIG. 4 is a side elevation showing the nailing operation using the same electric fastening tool; and FIG. 5 is a side elevation of nails connected in a step shape. In the following, the right and left sides of the electric fastening tool will means the right and left sides of the case, in which the electric fastening tool is seen from the operator in case the operator grips the handle portion of the electric fastening tool. Moreover, the top plan view is taken in FIG. 1 from above the electric fastening tool, and the bottom view is taken in FIG. 1 from below the electric fastening tool.

In an electric fastening tool 1 according to this embodiment, numeral 2 designates a housing made of a resin and acting as an exterior member. This housing 2 is constituted to include a generally cylindrical trunk portion 2A, and a handle portion 2B jointed generally in the shape of letter T, as viewed in a side view, to the trunk portion 2A. At the trailing end portion of the handle portion 2B (or at the free end portion on the side opposed to the trunk portion 2A) of the housing 2, moreover, there is disposed a battery pack 3, attached to the end of handle portion 2B through a battery pack supporting portion 2C, for housing the not-shown battery as the power source. Moreover, a trigger switch 4 is disposed at the handle portion 2B of the housing 2 and near the trunk portion 2A.

At the lower end of the housing 2, as shown in FIG. 1, there is disposed an ejection unit 17, to which a flat box-shaped magazine 5 is attached obliquely, in a side view, to the trunk portion 2A. In this magazine 5, as shown in FIG. 5, there are housed a number of nails 6, which are connected in a step shape. More specifically, the magazine 5 is attached, at its one end, to the ejection unit 17 (as located at the lower end portion of FIG. 1) disposed at the leading end of the trunk portion 2A of the housing 2 and, at its other end, to the trailing end portion of the handle portion 2B of the housing 2 and near the battery pack 3. In the state shown in FIG. 1, the magazine 5 is inclined obliquely upward from the ejection unit 17 disposed at the leading end of the trunk portion 2A of the housing 2 toward the trailing end portion of the handle portion 2B. As a result, the magazine 5 forms a triangular shape, in a side view, together with the trunk portion 2A and the handle portion 2B of the housing 2.

Thus, the electric fastening tool (or the portable fastening tool) 1 according to this embodiment is characterized in that the magazine 5 is attached obliquely in the bottom view (as taken from the side of the ejection port 17*a* of the ejection unit 17) to the handle portion 2B of the housing 2, as shown in FIG. 2. More specifically, the magazine 5 is attached so obliquely in a bottom view to the handle portion 2B of the housing 2 that it is turned in its entirety by a predetermined angle θ leftward (or upward of FIG. 2) on the ejection unit 17 disposed at the leading end of the trunk portion 2A of the housing 2. Here in this embodiment, the magazine 5 is attached obliquely to the handle portion 2B by turning it leftward of the bottom view on the ejection unit 17 disposed at the leading end of the trunk portion 2A of the housing 2. Alternatively, however, the magazine 5 may also be attached obliquely to the handle portion 2B by turning it rightward (or downward of FIG. 2).

As described above, the magazine 5 is attached obliquely of the side view to the trunk portion 2A of the housing 2 and obliquely of the bottom view to the handle portion 2B of the housing 2. As shown in FIG. 1, however, the magazine 5 is arranged to have its portion overlapping the battery pack 3 disposed at the trailing end portion of the handle portion 2B of the housing 2, as shown in FIG. 1, and is attached so obliquely to the handle portion 2B that its overlapping portion may have no interference (or overlap) with the battery pack 3, as shown in FIG. 2. Therefore, the inclination angle θ (as referred to FIG. 2), as taken in top plan view, of the magazine 5 with respect to the handle portion 2B of the housing 2 is set at such a value that a portion (which overlaps the battery pack 3 in a side view) of the housing 2 may not interfere, in a bottom view, with the battery pack 3.

The internal constitution of the housing 2 is described with reference to FIG. 3.

In the trunk portion 2A of the housing 2, there is housed in a horizontal position a motor 7 acting as a drive source, from which an output shaft (or motor shaft) 8 extends in the direction of the center of rotation thereof (i.e., in the direction normal to the sheet of FIG. 3). A drive gear 9 is fixed on the end portion of the output shaft 8.

On the side of the motor 7 in the trunk portion 2A of the housing 2, moreover, there is arranged the not-shown rotatable follower shaft in parallel with the output shaft 8 of the motor 7. This follower shaft has a pinion 10 fixed thereon and bears a flywheel 11 rotatably. This flywheel 11 meshes with the aforementioned drive gear 9.

Between the flywheel 11 and the follower shaft, although not shown, there is disposed a clutch mechanism for turning ON/OFF their connection selectively. This clutch mechanism is constituted to include a clutch spring wound on the flywheel 11 and the follower shaft, an electromagnetic solenoid acting as an actuator for winding the clutch spring on the outer circumference of the follower shaft, and a drive circuit for driving the electromagnetic solenoid.

In the trunk portion 2A of the housing 2, moreover, there is so housed a plunger 12 meshing with the pinion 10 that it can move reciprocally and linearly upward and downward of FIG. 3 along a guide rail 13. To the leading end (as located on the lower end of FIG. 3) of the plunger 12, there is attached a blade (or a punching portion) 14 for punching out the nails 6. Here, the plunger 12 is biased in such a direction (upward of FIG. 3) by the not-shown return spring as to return to the initial position.

Here are described the actions of the electric fastening tool 1 thus constituted.

The operator grips the handle portion 2B of the housing 2, as shown in FIG. 4, to hold the electric fastening tool 1 at one hand. When the trigger switch 4 is pulled and turned ON, the motor 7 is energized by the battery housed in the battery pack 3. The rotations of the output shaft 8 of the motor 7 are transmitted from the drive gear 9 to the flywheel 11 so that the flywheel 11 is rotationally driven to store the kinetic energy. At this time, the clutch mechanism is in OFF state, and the flywheel 11 and the driven shaft are disconnected. The flywheel 11 is freely (idly) rotating with respect to the follower shaft, so that the transmission of the power (or the kinetic energy) from the flywheel 11 to the follower shaft is blocked.

After lapse of a predetermined time period, the electromagnetic solenoid is energized by the not-shown drive circuit so that it is driven. Then, the clutch mechanism is turned ON to connect the flywheel 11 and the follower shaft so that the kinetic energy of the flywheel 11 is transmitted to rotate the follower shaft. When the driven shaft is thus rotationally driven, the pinion 10 fixed on the driven shaft rotates together, thereby to push the meshing plunger 12 in the punching direction (downward of FIG. 3) against the biasing force of the not-shown return spring. Then, the blade 14 attached to the leading end of the plunger 12 is also pushed in the same direction to impinge at its leading end against the nail 6 housed in the magazine 5. By this impinging force, the nail 6 is pushed from the ejection port 17*a* of the ejection unit 17 so that it is driven into a material such as wood W, as shown in FIG. 4.

When the nail 6 is driven into the wood W, as described above, the energization of the electromagnetic solenoid is interrupted and turned OFF, and the clutch mechanism is also turned OFF to disconnect the flywheel 11 and the follower shaft. Then, the follower shaft can rotate freely with respect to the flywheel 11 so that the plunger 12 and the blade 14 attached to the plunger 12 are moved upward of FIG. 3 their initial positions by the biasing force of the not-shown return spring.

By thus repeating the operations thus far described, the nails 6 shown in FIG. 5 can be continuously driven into the wood W shown in FIG. 4.

In the electric fastening tool 1 according to the embodiment, even if the magazine 5 having the nails 6 housed in the step shape, as shown in FIG. 5 is attached at an inclination with respect to the horizontal direction, the magazine 5 can be so attached while avoiding the handle portion 2B of the housing 2 as to hold the handle portion 2B at an angle near a horizontal direction. Moreover, the electric fastening tool 1 can be entirely shortened and can be easily pushed while gripping the handle portion 2B, so that it can punch the nails 6 stably.

Moreover, the magazine 5 is so arranged that its portion overlaps either the trailing end portion of the handle portion 2B of the housing 2 or the battery pack 3 in the side view. As a result, the height of the trailing end portion of the handle portion 2B (i.e., the height from the leading end punching portion of the trunk portion 2A) can be held small to shorten the entire length of the trunk portion 2A. Thus, the electric fastening tool 1 can be made so compact that it can be conveniently used in the narrow place, as shown in FIG. 4, so that it can nail even a narrow place highly efficiently.

In the embodiment, moreover, the magazine 5 is mounted obliquely in a top plan view, as shown in FIG. 2, with respect to the handle portion 2B so as to avoid the interference with the battery pack 3. As a result, the battery can be easily attached to or detached from the battery pack 3 so that it can be replaced easily and promptly. Even if the magazine 5 is attached obliquely in the top plan view to the handle portion 2B of the housing 2, the battery or a heavy component can be arranged at the low position so that the electric fastening tool (or the portable fastening tool) 1 can be well balanced in its weight and less damaged in its operation.

The embodiment of the invention has been described on the electric fastening tool as one example of the portable fastening tool. However, the invention can also be naturally applied to another portable fastening tool such as a gas fastening tool, in which a gas is burned by sparking it with a battery so that the nail is driven by the explosive force (or the combustion energy) of the gas.

The invention claimed is:

1. A portable fastening tool comprising:

a housing having a handle portion formed generally in a T-shape in a side view to extend from a main body disposed at first end of the handle portion, the main body including a nailing mechanism;

an ejection unit attached to a lower end of the housing and configured to eject nails in an ejecting direction;

a magazine attached to the ejection unit and having an extending portion extending from the ejection unit;

a motor housed in the housing;

a battery pack for driving the motor disposed at a second end of the handle portion opposite to the first end;

a battery pack supporting portion for supporting the battery pack, the battery pack supporting portion being provided at the second end of the handle portion;

a flywheel rotatably supported in the housing and rotationally driven by the motor; and a plunger adapted to be linearly moved in the housing by the rotation of the flywheel thereby to drive a nail from the ejection unit, wherein the magazine is inclined with respect to the ejecting direction in said side view, wherein the magazine is inclined with respect to the handle portion of the housing in a bottom view which is perpendicular to said side view and includes a view of the extending portion of the magazine, wherein, in the side view when the ejection unit is placed downwardly, the battery pack has a portion which elongates below the handle portion, wherein, in the side view when the ejection unit is placed downwardly, the battery pack supporting portion has a portion which elongates below the handle portion, wherein the magazine has an overlap portion overlapping said portion of the battery pack and said portion of the battery pack supporting portion in said side view, and wherein the magazine is connected to said portion of the battery pack supporting portion which elongates below the handle portion.

2. The portable fastening tool as set forth in claim 1, wherein the magazine is attached at one end of the magazine to the ejection unit, and wherein the magazine is deflected to the right or left on the one end of the magazine and is inclined with respect to the handle portion in said bottom view by a predetermined angle.

3. The portable fastening tool as set forth in claim 1, wherein an upper end of the battery pack is positioned lower than an upper end of the main body in the side view when the ejection unit is placed downwardly.

4. The portable fastening tool as set forth in claim 1, wherein:

the battery pack has an inserting portion configured to be inserted in the handle portion, and the inserting portion is located at off-center of the battery pack.

5. The portable fastening tool as set forth in claim 1, wherein:

the battery pack supporting portion is configured so that the battery pack is inserted thereinto, and the magazine is connected to said portion of the battery pack supporting portion via a bolt at a position not overlapping with the battery in said side view.

6. The portable fastening tool as set forth in claim 1, wherein the magazine is connected to a side portion of the battery pack supporting portion.

7. A portable fastening tool comprising:

a battery pack;

a handle portion having the battery pack at a first end portion thereof;

a batter pack supporting portion for supporting the battery pack, the battery pack supporting portion being provided at a second end portion of the handle portion opposite to the first end portion;

a main body connected to the handle portion;

an ejection unit disposed at the end of the main body and configured to eject nails in an ejecting direction; and a magazine connected to the ejection unit and having an extending portion extending from the ejection unit, wherein the magazine is inclined with respect to the ejecting direction when viewed from a side of the magazine, wherein the magazine is inclined with respect to the handle portion in a bottom view which is perpendicular to said ejecting direction and includes a view of the extending portion of the magazine, wherein, in the side view when the ejection unit is placed downwardly, the battery pack and the battery pack supporting portion elongate below the handle portion, wherein the magazine has an overlap portion overlapping a portion of the battery pack which elongates below the handle portion and a portion of the battery pack supporting portion which elongates below the handle portion in a side of the magazine, the side view being perpendicular to the bottom view and includes side views of the handle portion, the main body and the magazine, and wherein the magazine is connected to said portion of the battery pack supporting portion which elongates below the handle portion.

8. The portable fastening tool as set forth in claim 7, wherein an upper end of the battery pack is positioned lower than an upper end of the main body in the side view when the ejection unit is placed downwardly.

9. The portable fastening tool as set forth in claim 7, wherein:

the battery pack has an inserting portion configured to be inserted in the handle portion, and the inserting portion is located at off-center of the battery pack.

10. The portable fastening tool as set forth in claim 7, wherein:

the battery pack supporting portion is configured so that the battery pack is inserted thereinto, and the magazine is connected to said portion of the battery pack supporting portion via a bolt at a position not overlapping with the battery in said side view.

11. The portable fastening tool as set forth in claim 7, wherein the magazine is connected to a side portion of the battery pack supporting portion.

12. A portable fastening tool comprising:

a housing;

a handle portion extending from the housing in a handle extending direction;

a battery pack supporting portion connected to the handle portion;

a motor housed in the housing;

a battery pack supported by the battery pack supporting portion, the battery pack having an extending portion extending from the housing;

an ejection unit disposed at a lower end of the housing and configured to guide a nail in an ejecting direction; and a magazine connected to the ejection unit, wherein the magazine is inclined with respect to the ejecting direction in a side view, the side view being perpendicular to the handle extending direction and the ejecting direction, wherein the magazine is inclined with respect to the handle portion in a bottom view, wherein, in the side view when the ejection unit is placed downwardly, a part of the extending portion being positioned below the handle portion and overlapping with the magazine, wherein, in the side view when the ejection unit is placed downwardly, an upper end of the battery pack is positioned lower than an upper end of the housing, and wherein, in the side view when the ejection unit is placed downwardly, the motor is positioned lower than the handle portion.

13. A portable fastening tool comprising:

a housing;

a handle portion extending from the housing in a handle extending direction and having a central axis;

a battery pack supporting portion connected to the handle portion;

a motor housed in the housing;

a battery pack supported by the battery pack supporting portion, the battery pack having an extending portion extending from the housing;

an ejection unit disposed at the lower end of the housing and configured to guide a nail in an ejecting direction; and a magazine connected to the ejection unit, wherein the magazine is inclined with respect to the ejecting direction in a side view, the side view being perpendicular to the handle extending direction and the ejecting direction, wherein the magazine is inclined with respect to the handle portion in a bottom view, wherein, in the side view when the ejection unit is placed downwardly, a part of the extending portion being positioned below the handle portion and overlapping with the magazine, wherein the central axis of the handle portion is inclined with respect to the ejecting direction, wherein, in the side view when the ejection unit is placed downwardly, an upper end of the battery pack is positioned lower than an upper end of the housing, and wherein, in the side view when the ejection unit is placed downwardly, a center of the battery pack is positioned lower than the central axis of the handle portion.

14. The portable fastening tool as set forth in claim 13, wherein the battery pack has an inserting portion configured to be inserted in the handle portion, and the inserting portion is located at off-center of the battery pack.

15. The portable fastening tool as set forth in claim 13, wherein, in the side view when the ejection unit is placed downwardly, the motor is positioned lower than the handle portion.

* * * * *